US006281780B1

(12) United States Patent
Sugiyama et al.

(10) Patent No.: US 6,281,780 B1
(45) Date of Patent: Aug. 28, 2001

(54) ELECTRICAL APPARATUS HAVING IMPROVED ELECTRICAL CONTACT AND ELECTRICAL CONTACT USED THEREWITH

(75) Inventors: Akitsugu Sugiyama; Kouzoh Nagano, both of Gotenba; Harumi Kitada, Ooamishirasato-machi, all of (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/558,823

(22) Filed: Apr. 26, 2000

(30) Foreign Application Priority Data

Apr. 28, 1999 (JP) ..... 11-121950

(51) Int. Cl.[7] ..... H01H 61/00; H01H 71/18

(52) U.S. Cl. ..... 337/137; 337/329; 337/373; 337/399; 337/413; 200/268; 174/117 FF; 361/105

(58) Field of Search ..... 439/188; 337/109, 337/122, 137, 329, 373, 399, 413; 200/268, 269; 361/105; 310/251, 248, 252, 253; 174/117 FF

(56) References Cited

U.S. PATENT DOCUMENTS 4,050,044 * 9/1977 Fischer et al. ..... 337/137
5,036,379 * 7/1991 Smith et al. ..... 257/668
5,426,399 * 6/1995 Matsubayashi et al. ..... 333/1
5,489,762 * 2/1996 Martin et al. ..... 219/510

* cited by examiner

*Primary Examiner*—Brian Sircus
*Assistant Examiner*—Brian S. Webb
(74) *Attorney, Agent, or Firm*—Russell E. Baumann; Frederick J. Telecky, Jr.

(57) ABSTRACT

An electric apparatus (10) according to the present invention comprises electrically separated first and second terminals (14, 13), a first contact (16) that is connected electrically to the first terminal (14) within a casing (11), a second contact (15) that is connected electrically to the second terminal (13) within the casing and an operating member (20) for moving the first and second contacts relative to one another. In the present invention, at least the first contact (16) comprises a first conductive layer (41) with a given thickness including a face that is engageable with the second contact, a second conductive layer (42) that is connected to the first terminal (14), and insulating fiber (43) that is interposed between the first and second layers so that the above-mentioned second contact is engaged in the closing contacts movement by the insulating fiber when it is exposed by wear of the first layer (41) due to opening and closing movements of above mentioned contacts.

12 Claims, 3 Drawing Sheets

ELECTRICAL APPARATUS HAVING IMPROVED ELECTRICAL CONTACT AND ELECTRICAL CONTACT USED THEREWITH

FIELD OF THE INVENTION

This invention relates to an electrical apparatus having electrical contacts that are actuated on the basis of a selected change in temperature or in electric current and to an electrical apparatus which can be suitably employed as a thermostat or surge protector having an expected life of a limited number of cycles.

BACKGROUND OF THE INVENTION

There are many electrical apparatus whose main function lies in opening or closing a pair of electrical contacts in response to physical changes in the environment such as heat, electric current value, pressure or the like. In the case of this kind of electrical apparatus, whenever an anticipated physical change takes place in the apparatus, the electrical contacts are either opened or closed accordingly. Such electrical apparatus includes, for example, battery protectors, motor protectors, thermostats, pressure switches, circuit breakers, relays, etc. A battery protector or a motor protector is installed between the battery or motor and the target electrical product such as a portable computer, camera, communications equipment, automobile control equipment, or the like. In the case where an over-current has been produced in a battery (or in a motor), first and second contacts of the protector are separated from one another, thereby protecting the electrical product involved. In the case of a thermostat, the contacts are opened or closed in response to a selected change in the ambient temperature, thereby shutting off the power source and thus functioning in such a way as to maintain the ambient temperature constant.

A problem common to all of these electrical apparatus having such contacts is erosion or wear of the contacts due to arc discharges which are produced upon opening or closing of the contacts. When contacts that have been in engagement are separated from each other in the state where electric current has been impressed, an arc discharge is produced, with a result that a part of the contact material is eroded. By repeated opening and closing actions of the contacts, the contact material is reduced in a gradual manner and this limits the life of the apparatus.

Manufacturers of this kind of electrical apparatus, determine the expected number of cycles during the useful life of the apparatus due to wearing of the contacts by electric arc discharge and discourage use of the apparatus in excess of this number. In actuality, however, there are cases where these electrical apparatus are used in excess of the expected number. In such cases, it has been impossible to tell with conventional electrical apparatus if the final failure mode will end in contact welding or in a non-conductive state. In the former case, therefore, the electric apparatus does not function as desired and there is a danger of damaging the electrical product for which protection is intended.

SUMMARY OF THE INVENTION

Accordingly, an object of the present invention is the provision in electrical apparatus possessing a contact which is either opened or closed by a physical change, that the final failure mode ends in electrical non-conductivity.

Another object of the invention is the provision of electrical apparatus caving a useful life of a prescribed number of cycles and also providing apparatus having such a contact in which the circuit containing the contact becomes electrically non-conductive when the apparatus has finally failed.

Still another object of the invention is the provision of electrical apparatus having a circuit with openable and closeable contacts in which the final failure mode of the apparatus becomes electrically non-conductive and which is provided at a low cost and which is highly reliable.

Another object of the invention is the provision of electrical apparatus which overcomes the above noted limitations of the prior art.

Briefly stated, an electrical apparatus according to the invention comprises first and second terminals which are electrically separated and extend into a casing, a first contact which is electrically connected to the first terminal within the casing, a second contact which is electrically connected to the second terminal within the casing and an operating means which electrically connects or disconnects the first and second terminals by relatively connecting or disconnecting the first and second contacts. In accordance with the invention, at least the first contact comprises a first conductive layer of a prescribed thickness containing a surface that is engageable with the second contact, a second conductive layer that is connected to the first terminal, and an insulating fiber that is interposed between the first and second layers and the second contact effecting engagement with the insulating fiber when the insulating fiber has been exposed due to the wearing away of the first layer incident to the closing and opening movement of the first and second contacts.

In accordance with the invention, it is desirable that the first and second layers of the first contact be formed by mutually hot-pressing the layers together. It is also desirable in connection with the material of the contacts that the first layer be composed of a material whose main ingredients are silver (Ag) and nickel (Ni) alloys and whose second layer be composed of a material whose main ingredient is silver (Ag). In addition, it is desirable that the insulating fiber be composed of a suitable glass fiber.

In accordance with one embodiment of the invention, the first contact is a movable contact and the second contact is a stationary contact. It is desirable in connection with the operating means that the movable contact be moved in such a way that the contact surfaces of the contacts come into sliding engagement against each other. In this case, it is desirable for the insulating fiber to extend in a direction which crosses the direction in which the contact surfaces of the contacts slide against each other. According to the invention, moreover, it is desirable for the thickness of the first layer of the first contact to be selected based on the number of openings and closings of the contact that is to be provided.

According to an alternate feature of the invention, the operating means includes a member which is mechanically displaced in response to a selected variation in the ambient temperature, with the first contact being actuated by the mechanical displacement of the member. Accordingly, it is possible to use the electrical apparatus as a thermostat or as a protector that causes either contact engagement or disengagement of the first and second contacts when the ambient temperature has exceeded a prescribed value.

According to another alternate feature of the invention, the operating means contains a member that is mechanically displaced in response to a selected change in electric current, with the first contact being actuated by the mechanical displacement of the member. Accordingly, it becomes possible to use the electrical apparatus as a protector that will separate the first contact from the second contact when the electric current from the power source has exceeded a prescribed value.

According to yet another alternate feature of the invention, the operating means contains a member which is mechanically displaced in response to a selected variation in pressure, with the contacts being actuated by the mechanical displacement of the member. Accordingly, it becomes possible to use the electrical apparatus as a pressure switch that causes engagement or disengagement of the first and second contacts when the pressure of external fluid has exceeded a prescribed value.

The present invention also relates to electrical contacts for opening or closing the electric circuit. At least one electrical contact of a pair of contacts movable into and out of engagement with each other comprises, in accordance with the invention, a first layer having a prescribed thickness and containing a surface that is engageable with the other contact of the pair, a second layer that is connected with the electric circuit, and insulating fiber interposed between the first and second layers, with the other contact of the pair being engageable by the insulating fiber when the contacts move together and the fiber has been exposed due to wearing of the first layer in response to the closing and opening action vis-à-vis the other contact of the pair. In this connection, it is desirable that the first and second layers be applied to the contact by hot-pressing and that the first layer be composed of a material whose main ingredients are silver (Ag) and nickel (Ni) alloys and the second layer be composed of a material whose main ingredient is silver (Ag). Furthermore, it is desirable for the insulating fiber to be composed of glass fiber.

Additional objects and features of the invention will be set forth in part in the description which follows and in part will be obvious from the description. The objects and advantages of the invention may be realized and attained by means of the instrumentalities, combinations and articles particularly pointed out in the appended claims.

BRIEF DESCRIPTION OF THE DRAWINGS

The accompanying drawings incorporated in and constituted as a part of the specification, illustrate a preferred embodiment of the invention and, together with the description, serve to explain the objects, advantages and principles of the invention. In the drawings.

BRIEF DESCRIPTION OF PREFERRED EMBODIMENTS

The preferred embodiment of this invention, which will be explained hereafter, relates to an application to a battery protector which is to be used with portable electronic apparatus driven by batteries, such as portable computers, cameras, portable telephones and other communications equipment. The battery protector pertaining to this embodiment protects the electronic equipment from over-heating and excess electric current of the battery which is loaded on the electronic equipment. In this connection, it goes without saying that the application of the invention is not limited to battery protectors but it can be used in various kinds of electrical apparatus, as will be explained below.

Figure 1:
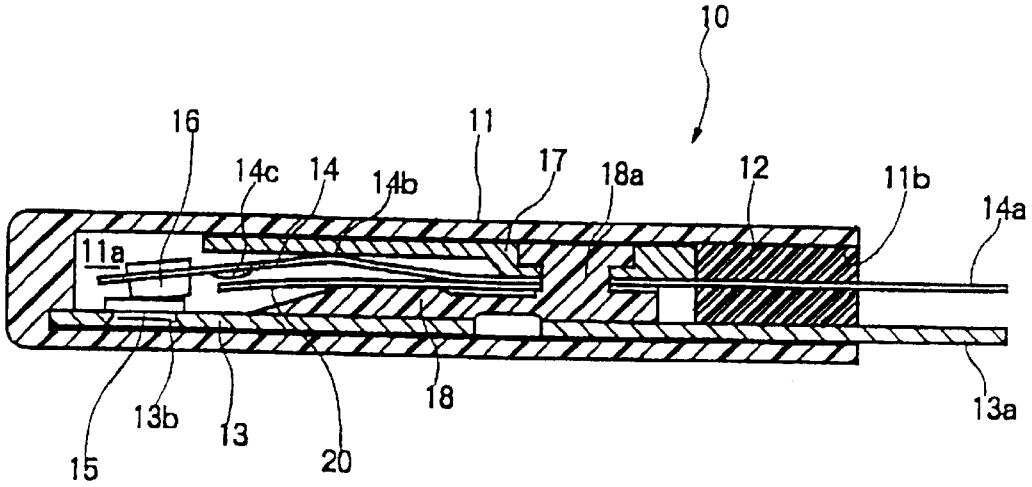
FIG. 1 is a cross sectional elevational view of a battery protector made in accordance with a preferred embodiment of the invention shown with a pair of electrical contacts in engagement with each other.
Figure 2:
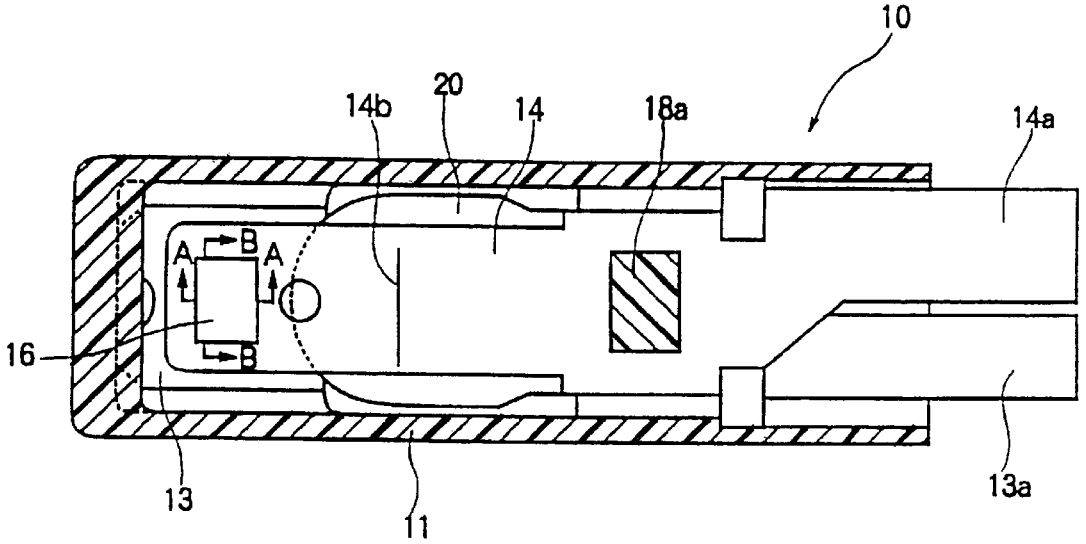
FIG. 2 is a cross sectional top view of the battery protector shown in FIG. 1.

As seen in FIGS. 1 and 2, battery protector 10 has a housing or casing 11 in the shape of a thin tube having one closed end. Casing 11 has an inner space or cavity 11 a where the functional members of the battery protector are disposed. After the functional members have been placed inside casing 11, a sealing member 12 is provided, as by pouring, in its opening 11b, thereby sealing the functional members within the casing.

Although it is necessary for the functional members of the battery protector to be electrically isolated from external influences, there is a need for them to be able to react to the thermal change of the battery that has been placed in its vicinity, as will be described below. The material for casing 10, therefore, is selected to electrically isolate the internal components from outside and, at the same time, to conduct heat from the ambient as much as possible. By way of example, nylon resin can be employed.

Battery protector 10 has a pair of leads 13 and 14 inside casing 11. One of the leads, lead 13, on the fixed side, supports stationary or fixed contact 15 at one end within casing 11 and terminal 13*a* at the other end which extends out of casing 11. By the same token, the other lead, lead 14, on the movable side, supports movable contact 16 toward one end within casing 11 and terminal 14*a* at the other end which extends out of casing 11. In the state where contacts 15 and 16 are in mutual engagement (the state indicated in FIG. 1), terminals 13*a* and 14*a* of each of the leads are respectively connected between the electrode of the battery and the electrical product to be protected, thereby forming a closed circuit. It is mentioned in this connection that stationary contact 15 is fixed such as by staking, etc., inside an opening 13*b* formed in the fixed-side lead 13 and is supported thereby.

Lead 14 on the movable side is fixed along with an operating member plate 20 formed of thermostat material, to be described below, with approximately its center disposed between a metallic holding plate 17 and a spaced apart portion of an electrically non-conductive block 18 of suitable material, such as resin. To be specific, thermostat plate 20 and lead 14 on the movable side are each provided with an aperture in which is fitted an engaging protrusion 18*a* formed on resin block 18, protrusion 18*a* and the apertures preferably having a non-circular portion to provide a selected angular orientation. A holding plate 17, also having an aperture, is inserted on top of lead 14 and thermostat plate 20. The top of engaging protrusion 18*a* is then deformed either by heat or ultrasonic energy so as to make the several parts effectively integral with one another. The portion of lead 14 extending from the position fixed by the engaging protrusion 18*a* to the end portion where the movable contact 16 is provided (which will hereafter be referred to as the tip side) is left basically free. The tip side, or free movable portion, of lead 14 is bent approximately in the shape of an elbow or a hill and, as shown in FIG. 1, the apex or bent point 14*b* is caused to hit upper holding plate 17 in the state where movable contact 16 is in engagement with stationary contact 15.

Lead 14 is an electrically conductive member formed of material capable of elastic deformation, such as beryllium copper. Because of the characteristics of the member, when thermostat plate 20, made of thermostat material, bends upwardly and pushes the convex dimple part 14*c* formed on lead 14 on the movable side upwardly, the tip side of lead 14 is elevated. It should be noted that thermostat plate 20 can be formed into a dished shape to make it snap-acting or, if desired, it can be formed without a dished shape to make it creep acting. As used in the following description, plate 20 will be referred to as snap-acting plate 20, and therefore provided with a dished shape. When snap-acting plate 20 returns to its original state, the tip side of lead 14 due to the spring characteristics of lead 14, is likewise returned with movable contact 16 in engagement with stationary contact 15. Lead 14 on the movable side conducts heat to snap-acting plate 20 generated by the electric current passing through the lead. In other words, lead 14 on the movable side is designed in such a way that lead 14 on the movable side heats up when excess current occurs. To facilitate heat transfer between lead 14 and snap-acting plate 20, it is desirable to use an arrangement in which snap-acting plate 20 and the surface of lead 14 on the movable side face against each other in close thermal proximity.

As described above, one end of snap-acting plate 20 is fixed, together with lead 14, by engagement protrusion 18*a* of block 18 deformed over plate 17. At normal times or when it is not in use, snap-acting plate 20 is slightly downwardly bent as shown in FIG. 1. The remainder of block 18 is positioned under snap-acting plate 20 and the distance snap-acting plate 20 can move from lead 14 on the movable side at normal times is limited by resin block 18.

Figure 3:
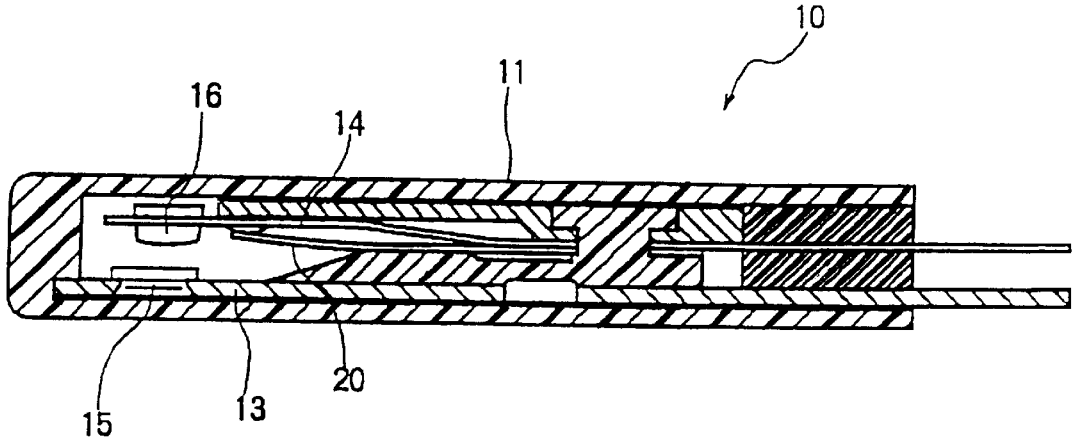
FIG. 3 corresponds to FIG. 1 in the state where an operating member has caused the contacts to be in disengagement.

As noted above, plate 20 is formed by using thermostat material, such as a bimetal, by bonding two or more layers of metals having different thermal coefficients of expansion and is so designed as to snap from the FIG. 1 configuration to the FIG. 3 configuration when the ambient temperature exceeds a prescribed temperature. When sufficient heat has been transferred to snap-acting plate 20 to cause its temperature to exceed the prescribed temperature, its tip side bends upwardly or, in other words, it snaps because of the difference in the rate of elongation and contraction between the different kinds of metals of which it is composed.

As a result of said snapping, the tip of the snap-acting plate 20 hits dimple 14*c*, with a result that lead 14 on the movable side is pushed upwardly separating movable contact 16 from stationary contact 15. The temperature elevation of snap-acting plate 20 reflects the temperature elevation of the ambient temperature of battery protector 10 and/or the heat generated by lead 14 on the movable side. Accordingly, in connection with heat generation by the battery that has been conducted or an excess electric current from the battery, snap-acting plate 20 is actuated, with a result that the power supply circuit is opened as shown in FIG. 3.

It is mentioned in this connection that holding plate 17 is made of a metal in the preferred embodiment and it is disposed between lead 14 on the movable side and casing 11. Thus, when lead 14 on the movable side has been heated by excess current, casing 11, which is preferably made of resin, is protected from being adversely affected by the heat.

Next, movable contact 16 in the preferred embodiment will be explained in detail. As noted above, FIGS. 4 and 5 are cross sectional views taken along lines A—A and B—B respectively in FIG. 2 and are cross sections of the movable contact. As shown in these figures, movable contact 16 is composed of a metal contact layer 41 on the side of the contact facing stationary contact 15, and a base metal layer 42 on the side where lead 14 on the movable side is fixed plus an insulating fiber layer 43 interposed between layers 41, 42.

Figure 4:
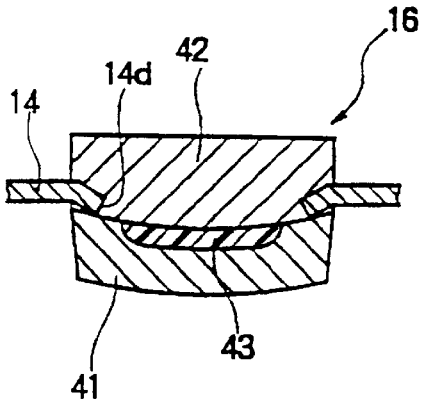
FIG. 4 is a cross sectional view taken along line A—A in FIG. 2 showing the cross section of the movable contact.
Figure 5:
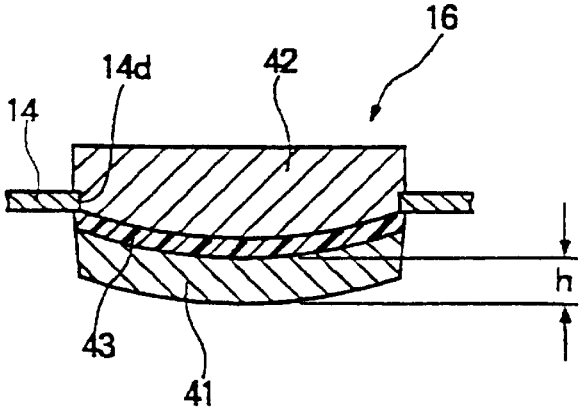
FIG. 5 is a cross sectional view taken along line B—B in FIG. 2 showing the cross section of the movable contact.

Movable contact 16 is desirably a clad member formed by mutually hot-pressing contact layer 41 and base material layer 42 to sandwich insulating layer 43. Movable contact 16, formed in this manner, is fixed by staking the periphery on the side of base material layer 42 in opening 14*d* of the lead on the movable side. In other words, it is formed so that lead 14 on the movable side and the material layer 42 side of the movable contact 16 are directly conductive. Electrical conductance between base material layer 42 and contact layer 41 is effected on both sides of the insulating layer 43 in the direction of the longitudinal axis of lead 14 as shown in FIG. 4, i.e., that part where the base material layer 42 and the contact layer 41 directly contact each other.

It is mentioned in this connection that it is desirable for the base material layer to be formed with silver (Ag) and for contact layer 41 to be formed with an alloy of silver (Ag) and nickel (Ni) alloyed at the ratio of approximately 90:10). The thickness (dimension h in FIG. 5) of contact layer 41 can be selected in accordance with the desired estimated number of cycles as stipulated for the battery protector as a product. In other words, contact layer 41 is gradually consumed and reduced in thickness by electric arc discharges produced upon openings and closings of the contacts. Arcing occurs due to electric current that is impressed from the connected battery to the contact and causes the contact surface of contact layer 41 to evaporate. Due to repetition of openings and closings of the contacts, contact layer 41 is gradually eroded off the contact surface, with insulating layer 43 finally being exposed. An approximate selected number of contact opening and closing cycles before insulating layer 43 becomes exposed can be obtained by selecting an appropriate thickness of contact layer 41.

Insulating layer 43, composed of insulating fiber, becomes operative when contact layer 41 is almost completely consumed and the insulating fiber is exposed for the first time. As contact layer 41 is gradually consumed by electric arc discharges generated each time opening and closing of the contacts occur, insulating layer 43 is finally exposed on the side facing stationary contact 15 and stationary contact 15 then engages the surface of insulating layer 43 in its closed state.

Figure 6:
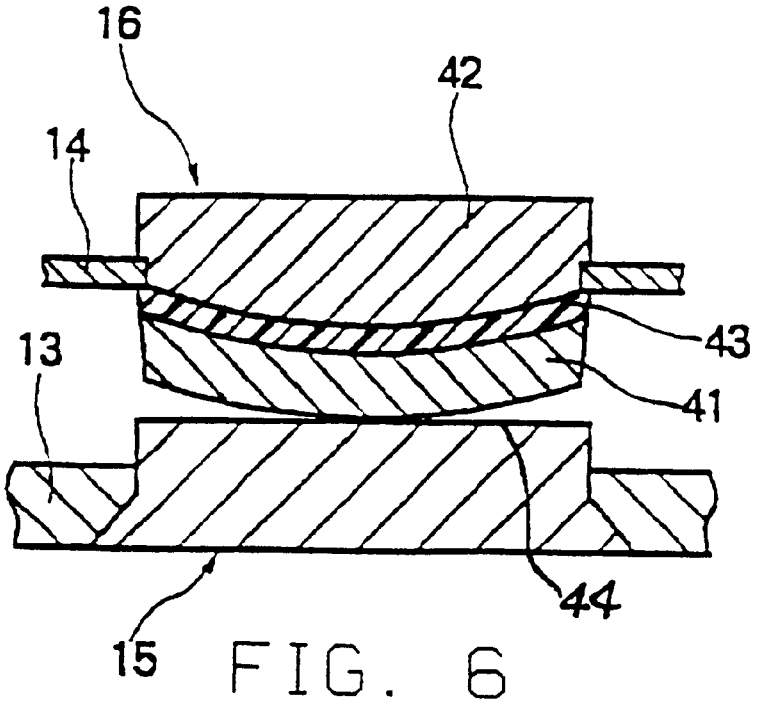
FIGS. 6 and 7 are cross sectional views showing, respectively, the state of contact engagement between the movable contact and the fixed contact before and after wearing of the contact layer of the movable contact.
Figure 7:
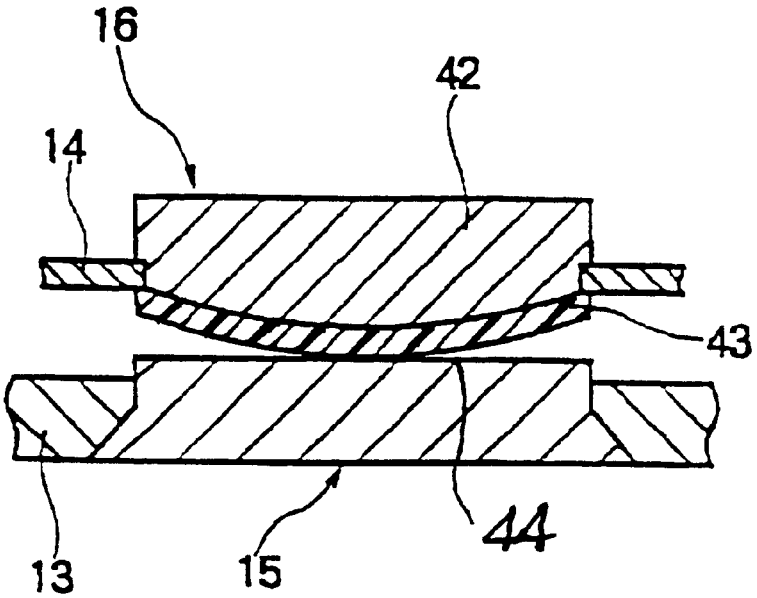

FIG. 6 shows the normal state of engagement between movable contact 16 and stationary contact 15 and, after the wearing of contact layer 41, FIG. 7 shows the state in which contact layer 41 of movable contact 16 has been consumed and, at the same time, shows the state in which the contact surface 44 of the stationary contact 15 is likewise being consumed. The state in which the contact layer 41 has approximately completely been consumed (the state shown in FIG. 7) indicates the final state of battery protector 10 or the final failure mode. In the state where the mutual contacts have been closed as shown in FIG. 7, the conductive parts of movable contact 16 become completely non-conductive. As a consequence of this, non-conductivity as the final failure mode of the battery protector 10 is assured.

The insulating fiber that comprises insulating layer 43 in this invention is preferably glass fiber. A plurality of single yams obtained by giving one directional twisting to the strands that have been made fibrous by several (mu)m can be used as the base material for insulating layer 43. The glass fiber prior to the compressive adhesion of said contact layer 41 and the base material layer 42 has a cross section which is approximately circular; however, the fiber is crushed by the compression of the layers and becomes a layer having a prescribed width and thickness. In an example, Micro-Glass Yarn YECG 75 1/3 (a product of Nippon Sheet Glass Company, Limited) was used as glass fiber constituting said insulating layer 43 in making contacts according to the invention.

Movable contact 16 made as described above can be prepared by hot-pressing layers of the metals to sandwich the glass fiber, followed by cutting into blocks. The preparation of the contacts by this method is extremely productive and provides a fixed yield. Insulating layer 43 made of fibers has a high level of pliability with a result that no great differences in the thickness of the contact layer 41 are produced. Because of this, it becomes possible to predict the number of stable cycles until the contact becomes non-conductive.

The forms of implementation of this invention have been explained above. It is obvious that the range of applicability of this invention is not restricted to those items which have been shown in the above examples. The arrangements of the insulating layer inside the contact are not limited to those shown in the above examples. Any arrangement of the insulating layer can be used, provided that the stationary contact can engage the insulating layer when the contact layer is worn and the insulating layer has been exposed. In such case, it is desirable to determine the arrangement of the insulating layer in due consideration of the surface direction at the opening and closing of both contacts.

In an arrangement where the movable contact moves along a curved path, the mutual contact surfaces generally slide against each other upon engagement or disengagement vis-à-vis the stationary contact, generally in a direction along the longitudinal axis of the movable portion of lead 1. Accordingly, it is desirable to arrange the insulating layer in due consideration of such movement. For example, the accurate functioning of the insulating layer is assured by arranging the insulating fiber in a direction which crosses the longitudinal axis of the movable portion of lead 14, in the arrangement of the example at 90 degrees.

In the embodiment described above, moreover, a clad member with an insulating fiber is provided in the movable contact. However, the insulating fiber may be provided in the stationary contact or in both of the contacts. This invention can be used widely not only for battery protectors as noted but also for various electrical apparatus whose main function lies in opening and closing contacts by a variation in the environment, for example, motor protectors, thermostats, pressure switches, circuit breakers, relays, and the like.

According to the invention described above, the non-conductivity of the final failure mode in the electrical apparatus having contacts that are opened or closed by a physical change is provided thereby improving the reliability of the apparatus. In this case, the desired number of cycles of the electrical apparatus is assured. According to the invention, moreover, it is possible to prepare the electrical apparatus having contacts where the final failure mode has been made non-conductive at low cost and with improved reliability.

Although the invention has been described with regard to a specific preferred embodiment thereof, variations and modifications will become apparent to those skilled in the art. It is, therefore, the intention that the appended claims be interpreted as broadly as possible in view of the prior art to include all such variations and modifications.

What is claimed:

1. An electrical apparatus comprising a casing, first and second terminals which are electrically separated extending from without the casing into the casing, a first contact which is electrically connected to the first terminal within the casing, a second contact which is electrically connected to the second terminal within the casing, and an operating member which electrically connects and disconnects said first and second terminals by relatively connecting and disconnecting said first and second contacts, the first and second contacts each having a contact surface, the contacts being movable relative to one another, at least the said first contact comprising a first layer of a prescribed thickness having the contact surface that engages the contact surface of the second contact when the first and second contacts are connected, a second layer connected to the first terminal within the housing, and an electrically insulating fiber that is interposed between the first and second layers and the second contact effecting engagement with the electrically insulating fiber when the fiber has been exposed due to wear of said first layer in response to engaging and disengaging movement of the first and second contacts.

2. An electric apparatus according to claim 1 wherein the first layer is composed of a material whose main ingredients are silver (Ag) and nickel (Ni) and the second layer is composed of a material whose main ingredient is silver (Ag).

3. An electric apparatus according to claim 1 wherein the electrically insulating fiber is glass fiber.

4. An electric apparatus according to claim 1 wherein said first contact is a movable contact and said second contact is a stationary contact.

5. An electric apparatus according to claim 4 wherein the operating means moves the first contact in such a fashion that the contact surface of the first contact and the contact surface of the second contact slidingly engage each other.

6. An electric apparatus according to claim 3 wherein the insulating fiber is disposed in alignment with a location of the contact surfaces which slidingly engage each other.

7. An electric apparatus according to claim 6 in which the contacts slidingly engage each other in a selected first direction and the insulating fiber extends generally in a second direction generally ninety degrees relative to the first direction.

8. An electric apparatus according to claim 4 wherein the operating member is mechanically displaced in response to selected variations in the ambient temperature, with movement of the first contact being actuated by the mechanical displacement of said member.

9. An electric apparatus according to claim 4 wherein said operating member is mechanically displaced in response to a selected change in electric current passing through the apparatus, with movement of the first contact being actuated by the mechanical displacement of the member.

10. An electric contact for opening or closing an electric circuit comprising a first layer of electrically conductive material of a prescribed thickness that includes a contact surface, a second layer of electrically conductive material for connection to the electric circuit, and an insulating fiber that is interposed between the first and second layers, whereby wearing away of the first layer eventually exposes the insulating fiber in response to engaging and disengaging movement of the first and second contacts.

11. An electric contact according to claim 10 wherein the first layer is composed of a material whose main ingredients are silver (Ag) and nickel (Ni) and the second layer is composed of a material whose main ingredient is silver (Ag).

12. An electric contact according to claim 10 wherein said insulating fiber is glass fiber.

* * * * *